US007926911B2

(12) United States Patent
Tsuruko

(10) Patent No.: US 7,926,911 B2
(45) Date of Patent: Apr. 19, 2011

(54) NOZZLE PLATE, METHOD FOR PRODUCING NOZZLE PLATE, AND METHOD FOR PRODUCING INK-JET HEAD

(75) Inventor: Masanori Tsuruko, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 449 days.

(21) Appl. No.: 12/033,881

(22) Filed: Feb. 19, 2008

(65) Prior Publication Data

US 2008/0198200 A1 Aug. 21, 2008

(30) Foreign Application Priority Data

Feb. 19, 2007 (JP) ..... 2007-037841

(51) Int. Cl.
*B41J 2/14* (2006.01)

(52) U.S. Cl. ..... 347/47; 347/48; 347/68; 347/69; 347/70; 347/71; 347/72

(58) Field of Classification Search ..... 347/1–109
See application file for complete search history.

(56) References Cited

U.S. PATENT DOCUMENTS 5,653,901 A * 8/1997 Yoshimura ..... 219/121.71
5,852,456 A * 12/1998 Okada et al. ..... 347/71
2002/0085067 A1 7/2002 Palifka et al.

FOREIGN PATENT DOCUMENTS

JP 7032598 A 2/1995
JP 2006305767 A 11/2006
WO 02078960 A 10/2002

* cited by examiner

*Primary Examiner* — Ryan Lepisto
*Assistant Examiner* — Guy G Anderson
(74) *Attorney, Agent, or Firm* — Baker Botts L.L.P.

(57) ABSTRACT

A nozzle plate includes a first thermoplastic resin film; a reinforcing plate which is formed of a material having a rigidity higher than that of the first thermoplastic resin film and which has one surface joined to the first thermoplastic resin film; and a second thermoplastic resin film which is joined to the other surface of the reinforcing plate; wherein a nozzle is formed for the first thermoplastic resin film; and through-holes, which are communicated with the nozzle, are formed through the reinforcing plate and the second thermoplastic resin film. Therefore, the nozzle plate can be produced without using any adhesive. Further, the thermoplastic resin films are joined to the both surfaces of the reinforcing plate. Therefore, any warpage is hardly caused in the reinforcing plate and the first and second thermoplastic resin films, which would be otherwise caused by the difference in coefficient of thermal expansion.

17 Claims, 9 Drawing Sheets

NOZZLE PLATE, METHOD FOR PRODUCING NOZZLE PLATE, AND METHOD FOR PRODUCING INK-JET HEAD

CROSS REFERENCE TO RELATED APPLICATION

The present application claims priority from Japanese Patent Application No. 2007-037841, filed on Feb. 19, 2007, the disclosure of which is incorporated herein by reference in its entirety.

BACKGROUND OF THE INVENTION

1. Field of the Invention

The present invention relates to a nozzle plate formed with a plurality of nozzles, a method for producing the nozzle plate, and a method for producing an ink-jet head provided with the nozzle plate.

2. Description of the Related Art

A certain ink-jet head for discharging an ink from nozzles is known, wherein a plurality of plates, which include a nozzle plate formed with the nozzles, are stacked to one another, and thus ink flow passages, through which the ink is allowed to flow, are formed. For example, in an ink-jet head described in Japanese Patent Application Laid-open No. 2006-305767, five plates in total, i.e., a nozzle plate formed of a synthetic resin material, a base plate, a manifold plate, a spacer plate, and a cavity plate each formed of a metal material are stacked to one another, and they are joined or bonded to one another by an adhesive. A cavity unit (flow passage unit), which has ink flow passages ranging from an ink supply port via pressure chambers to nozzles, is constructed by these plates.

However, in the case of Japanese Patent Application Laid-open No. 2006-305767, the five plates are joined to one another by the adhesive in such a state that through-holes, which serve as the ink flow passages including, for example, the nozzles and the pressure chambers, are formed. Therefore, it is feared that the adhesive may protrude into the ink flow passage through any gap between the plates, and the discharge characteristic of the ink to be discharged from the nozzle may be consequently changed. In view of such a circumstance, the following procedure may be also conceived in order that the five plates are joined or bonded to one another without using the adhesive. That is, for example, the nozzle plate is also formed of a metal material in the same manner as the other four plate, and the five plates are joined to one another by the diffusion bonding or diffusion joining. However, in this procedure, it is difficult to perform the processing in order that minute nozzles are formed in the nozzle plate formed of the metal material.

SUMMARY OF THE INVENTION

An object of the present invention is to provide a nozzle plate which is capable of being joined to other members without using any adhesive and which is produced with ease, a method for producing the nozzle plate, and a method for producing an ink-jet head provided with the nozzle plate as described above.

According to a first aspect of the present invention, there is provided a nozzle plate including: a first thermoplastic resin film; a reinforcing plate formed of a material having a rigidity higher than that of the first thermoplastic resin film and having one surface as a joining surface at which the reinforcing plate is joined to the first thermoplastic resin film; and a second thermoplastic resin film which is joined to the other surface of the reinforcing plate, wherein a nozzle is formed in the first thermoplastic resin film, and a through-hole, which is communicated with the nozzle, is formed in each of the reinforcing plate and the second thermoplastic resin film.

According to the first aspect of the present invention, the first thermoplastic resin film, the second thermoplastic resin film, and the reinforcing plate are stacked to each other, and they are heated while pressing them in the stacking direction. Accordingly, the first thermoplastic resin film, the second thermoplastic resin film, and the reinforcing plate can be joined or bonded to each other. Therefore, the nozzle plate can be produced without using any adhesive.

Further, the thermoplastic resin films are joined to the both surfaces of the reinforcing plate. Therefore, any warpage is hardly caused in the reinforcing plate and the first and second thermoplastic resin films, which would be otherwise caused by the difference in coefficient of thermal expansion among the first and second thermoplastic resin films and the reinforcing plate. Additionally, the through-hole and the minute nozzle can be easily formed in the thermoplastic resin films, for example, by the laser processing.

In the nozzle plate of the present invention, the reinforcing plate may be formed of a metal material. In this case, the rigidity of the nozzle plate is sufficiently enhanced, because the reinforcing plate is formed of the metal material. Further, owing to the fact that the reinforcing plate is formed of the metal material, the through-hole can be easily formed, for example, by the etching.

In the nozzle plate of the present invention, the first thermoplastic resin film and the second thermoplastic resin film may be formed of a same thermoplastic resin material. In this case, the thermoplastic resin films, which are formed of the same thermoplastic resin material, are joined to the both surfaces of the reinforcing plate. Therefore, any warpage is more hardly caused in the reinforcing plate and the first and second thermoplastic resin films, which would be otherwise caused by the difference in coefficient of thermal expansion among the first and second thermoplastic resin films and the reinforcing plate.

In the nozzle plate of the present invention, the first thermoplastic resin film and the second thermoplastic resin film may have a same thickness. In this case, any warpage is more hardly caused in the reinforcing plate and the first and second thermoplastic resin films, which would be otherwise caused by the difference in coefficient of thermal expansion among the first and second thermoplastic resin films and the reinforcing plate.

According to a second aspect of the present invention, method for producing the nozzle plate as defined in the first aspect, including: joining the first thermoplastic resin film and the reinforcing plate to each other by stacking the first thermoplastic resin film and the reinforcing plate in a stacking direction and heating the first thermoplastic resin film and the reinforcing plate while pressing the first thermoplastic resin film and the reinforcing plate in the stacking direction; and joining the reinforcing plate and the second thermoplastic resin film to each other by stacking in the stacking direction the second thermoplastic resin film on the other surface of the reinforcing plate, the other surface being opposite to the joining surface, and heating the reinforcing plate and the second thermoplastic resin film while pressing the reinforcing plate and the second thermoplastic resin film in the stacking direction.

According to the second aspect of the present invention, the first thermoplastic resin film, the second thermoplastic resin film, and the reinforcing plate can be joined to each other by stacking the first thermoplastic resin film, the second thermoplastic resin film, and the reinforcing plate and heating them while pressing them in the stacking direction. Therefore, the nozzle plate can be produced without using any adhesive.

In the method for producing the nozzle plate of the present invention, the nozzle may be formed in the first thermoplastic resin film and the through-hole may be formed in the reinforcing plate, before joining the first thermoplastic resin film and the reinforcing plate, and the through-hole may be formed in the second thermoplastic resin film before joining the reinforcing plate and the second thermoplastic resin film. The first and second thermoplastic resin films and the reinforcing plate are formed of mutually different materials. Therefore, if the nozzle and the through-holes are formed after joining the first and second thermoplastic resin films and the reinforcing plate, it is feared that the steps of forming the nozzle and the through-holes may be complicated. According to the production method of the present invention, the nozzle and the through-holes can be formed with ease, because the nozzle and the through-hole are formed before the joining.

In the method for producing the nozzle plate of the present invention, the reinforcing plate may be formed of a metal material, the through-hole may be formed in the reinforcing plate by etching before joining the first thermoplastic resin film and the reinforcing plate; the nozzle may be formed in the first thermoplastic resin film by laser processing after joining the first thermoplastic resin film and the reinforcing plate; and the through-hole may be formed in the second thermoplastic resin film by laser processing after joining the reinforcing plate and the second thermoplastic resin film. When the reinforcing plate is formed of the metal material, the through-hole can be easily formed in the reinforcing plate by the etching, provided that the through-hole is formed in the reinforcing plate before joining the reinforcing plate and the first thermoplastic resin film. Further, the nozzle and the through-holes can be formed in the first and second thermoplastic resin films respectively by the laser processing even after the reinforcing plate, the first thermoplastic resin film, and the second thermoplastic resin film are joined to each other.

In the method for producing the nozzle plate of the present invention, after joining the reinforcing plate and the second thermoplastic resin film, the through-hole may be formed in each of the second thermoplastic resin film and the reinforcing plate and the nozzle may be formed in the first thermoplastic resin film. In this procedure, the nozzle and the through-hole are formed after joining the first and second thermoplastic resin films and the reinforcing plate. Therefore, it is unnecessary to perform the positional adjustment between the nozzle and the through-hole and between the through-holes.

According to a third aspect of the present invention, there is provided a method for producing the nozzle plate as defined in the first aspect, including: joining the second thermoplastic resin film and the reinforcing plate to each other by stacking the second thermoplastic resin film and the reinforcing plate in a stacking direction and heating the second thermoplastic resin film and the reinforcing plate while pressing the second thermoplastic resin film and the reinforcing plate in the stacking direction; and joining the reinforcing plate and the first thermoplastic resin film to each other by stacking the first thermoplastic resin film on the other surface of the reinforcing plate in the stacking direction, the other surface being opposite to the second thermoplastic resin film, and heating the reinforcing plate and the first thermoplastic resin film while pressing the reinforcing plate and the first thermoplastic resin film in the stacking direction.

According to the third aspect of the present invention, the nozzle plate can be produced without using any adhesive.

In the method for producing the nozzle plate of the present invention, the through-hole may be formed in each of the second thermoplastic resin film and the reinforcing plate before joining the second thermoplastic resin film and the reinforcing plate, and the nozzle may be formed in the first thermoplastic resin film before joining the reinforcing plate and the first thermoplastic resin film. According to the production method of the present invention, the through-hole and the nozzle are formed before joining the second thermoplastic resin film, the reinforcing plate, and the first thermoplastic resin film. Therefore, the through-hole and the nozzle can be formed with ease.

In the method for producing the nozzle plate of the present invention, the reinforcing plate may be formed of a metal material, the through-hole may be formed in the reinforcing plate by etching before joining the second thermoplastic resin film and the reinforcing plate, the through-hole may be formed in the second thermoplastic resin film by laser processing after joining the second thermoplastic resin film and the reinforcing plate, and the nozzle may be formed in the first thermoplastic resin film by laser processing after joining the reinforcing plate and the first thermoplastic resin film. When the reinforcing plate is formed of the metal material, the through-hole can be easily formed in the reinforcing plate by the etching, provided that the through-hole is formed in the reinforcing plate before joining the reinforcing plate and the second thermoplastic resin film. Further, the through-hole and the nozzle can be formed in the second and first thermoplastic resin films respectively by the laser processing even after the reinforcing plate, the second thermoplastic resin film, and the first thermoplastic resin film are joined to each other.

In the method for producing the nozzle plate of the present invention, after joining the reinforcing plate and the first thermoplastic resin film, the through-hole may be formed in each of the reinforcing plate and the second thermoplastic resin film and the nozzle may be formed in the first thermoplastic resin film. In this procedure, the nozzle and the through-hole are formed after joining the first and second thermoplastic resin films and the reinforcing plate. Therefore, it is unnecessary to perform the positional adjustment between the nozzle and the through-hole and between the through-holes.

According to a fourth aspect of the present invention, there is provided a method for producing the nozzle plate as defined in the first aspect, including: stacking the first thermoplastic resin film and the reinforcing plate and stacking the second thermoplastic resin film on the other surface of the reinforcing plate in the stacking direction, the first thermoplastic resin film not being stacked on the other surface; and joining the first thermoplastic resin film and the reinforcing plate to each other and joining the reinforcing plate and the second thermoplastic resin film to each other by heating the first thermoplastic resin film, the reinforcing plate, and the second thermoplastic resin film while pressing the first thermoplastic resin film, the reinforcing plate, and the second thermoplastic resin film in the stacking direction.

According to the fourth aspect of the present invention, the first thermoplastic resin film and the reinforcing plate as well as the reinforcing plate and the second thermoplastic resin film can be simultaneously joined to each other. Therefore, it is possible to simplify the steps of producing the nozzle plate.

In the method for producing the nozzle plate of the present invention, after joining the first thermoplastic resin film and the reinforcing plate and joining the reinforcing plate and the second thermoplastic resin film, the through-hole may be formed in each of the reinforcing plate and the second thermoplastic resin film and the nozzle may be formed in the first thermoplastic resin film. In this procedure, the nozzle and the through-hole are formed after joining the first and second thermoplastic resin films and the reinforcing plate. Therefore, it is unnecessary to perform the positional adjustment between the nozzle and the through-hole and between the through-holes.

According to a fifth aspect of the present invention, there is provided an ink-jet head including: a flow passage unit which is constructed by stacking the nozzle plate as defined in claim 1 on a plurality of plates each formed of a metal material, the flow passage having an ink flow passage including the nozzle and a pressure chamber communicated with the nozzle; and a piezoelectric actuator applying a jetting pressure to an ink in the pressure chamber and having a vibration plate formed of a metal material and arranged on a surface of the flow passage unit to cover the pressure chamber therewith, a piezoelectric layer arranged on a surface of the vibration plate not facing the flow passage unit, and a driving electrode arranged on a surface of the piezoelectric layer.

According to the fifth aspect of the present invention, the nozzle plate is produced without using any adhesive. Therefore, the adhesive does not protrude to the ink flow passage. It is possible to provide the ink-jet head which is excellent in the ink discharge characteristic.

According to a sixth aspect of the present invention, there is provided a method for producing an ink-jet head provided with: a flow passage unit which is constructed by stacking the nozzle plate as defined in the first aspect and a plurality of plates with one another, each of the plates being formed of a metal material, the flow passage unit having an ink flow passage including the nozzle and a pressure chamber communicated with the nozzle; and a piezoelectric actuator applying a jetting pressure to an ink in the pressure chamber and having a vibration plate formed of a metal material and arranged on a surface of the flow passage unit to cover the pressure chamber therewith, a piezoelectric layer arranged on a surface of the vibration plate not facing the flow passage unit, and a driving electrode arranged on a surface of the piezoelectric layer, the method including: providing the nozzle plate; stacking the plurality of plates and the vibration plate and joining the plurality of plates and the vibration plate to one another in a stacking direction by diffusion bonding; forming the piezoelectric layer on the surface of the vibration plate not facing the plurality of plates, by a particle deposition method; forming the driving electrode on the surface of the piezoelectric layer; and joining the nozzle plate to a surface of a first plate, among the plurality of plates, not facing the vibration plate, the first plate being joined to the vibration plate at a position farthest from the vibration plate, wherein, when the nozzle plate is joined to the first plate, the nozzle plate is stacked on the surface of the first plate not facing the vibration plate so that the surface of the first plate not facing the vibration plate makes contact with a surface, of the second thermoplastic resin film, not facing the reinforcing plate, and the nozzle plate, the plurality of plates, and the piezoelectric actuator are heated while pressing the nozzle plate, the plurality of plates, and the piezoelectric actuator in the stacking direction of the nozzle plate, the plurality of plates, and the piezoelectric actuator.

According to the sixth aspect of the present invention, the nozzle plate and the parts to be joined to the nozzle plate are stacked so that the surface of the second thermoplastic resin film not facing the reinforcing plate makes contact with the parts. They are heated while pressing them in the stacking direction. Accordingly, the nozzle plate and the parts can be joined to each other without using any adhesive. In other words, the respective parts, which constitute the ink-jet head, can be joined or bonded to each other without using any adhesive.

DESCRIPTION OF THE PREFERRED EMBODIMENTS

A preferred embodiment of the present invention will be explained below.

Figure 1:
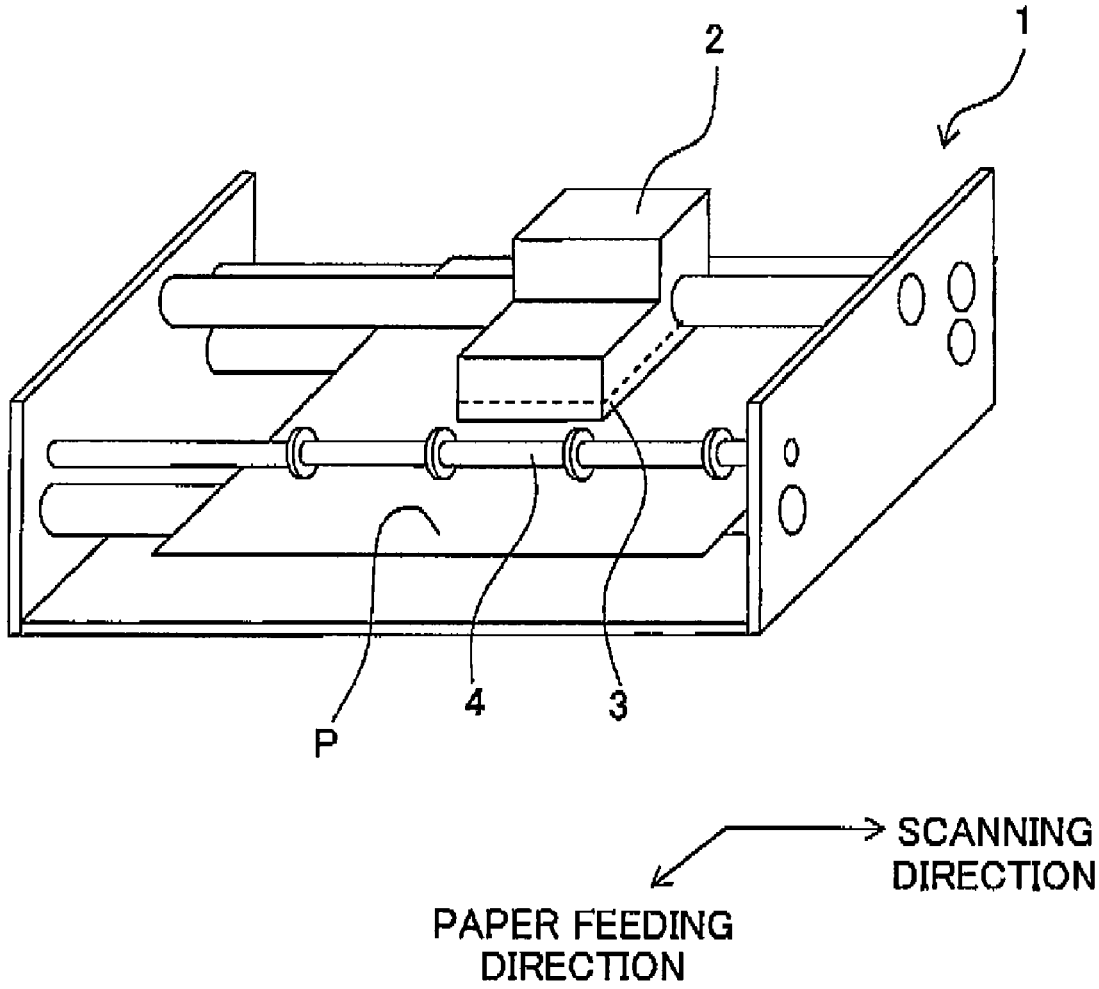
FIG. 1 shows a schematic arrangement illustrating a printer according to an embodiment of the present invention.

FIG. 1 shows a schematic arrangement illustrating a printer according to the embodiment of the present invention. As shown in FIG. 1, the printer 1 is provided with, for example, a carriage 2, an ink-jet head 3, and recording paper transport rollers 4. The carriage 2 is supported so that the carriage 2 is capable of making the reciprocating movement in the left-right direction (scanning direction) as shown in FIG. 1. The ink-jet head 3 is arranged on the lower surface of the carriage 2. The ink-jet head 3 discharges the ink from a plurality of nozzles 17 (see FIG. 2) formed on the lower surface thereof, while being moved in the scanning direction together with the carriage 2. The recording paper transport rollers 4 transport the recording paper P in the frontward direction (paper feeding direction) as shown in FIG. 1. In the printer 1, the printing is performed on the recording paper P such that the ink is discharged from the nozzles 17 of the ink-jet head 3 which reciprocates in the scanning direction together with the carriage 2, onto the recording paper P which is transported in the paper feeding direction by the printing paper transport rollers 4.

Figure 2:
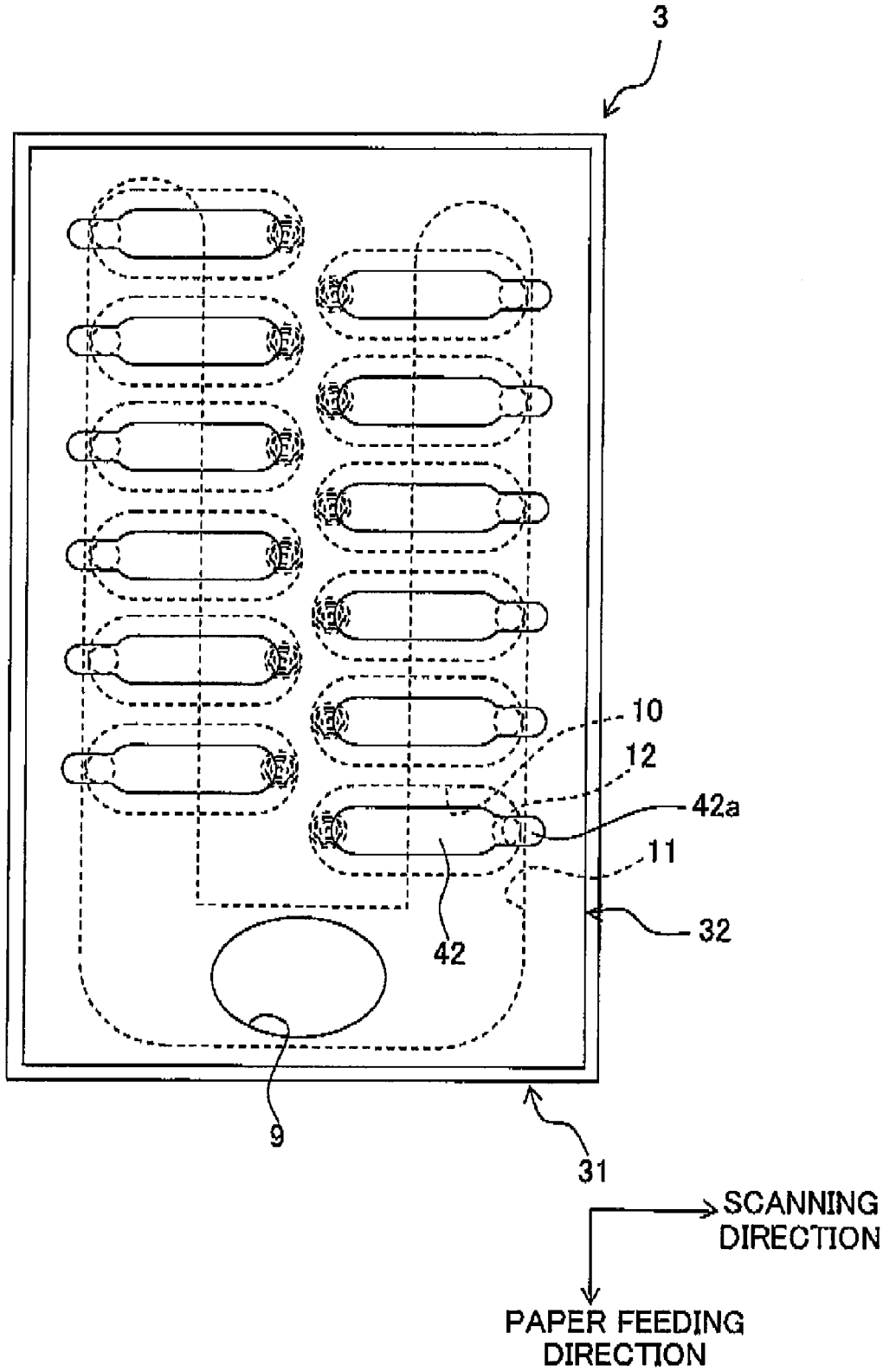
FIG. 2 shows a plan view illustrating an ink-jet head shown in FIG. 1.
Figure 3:
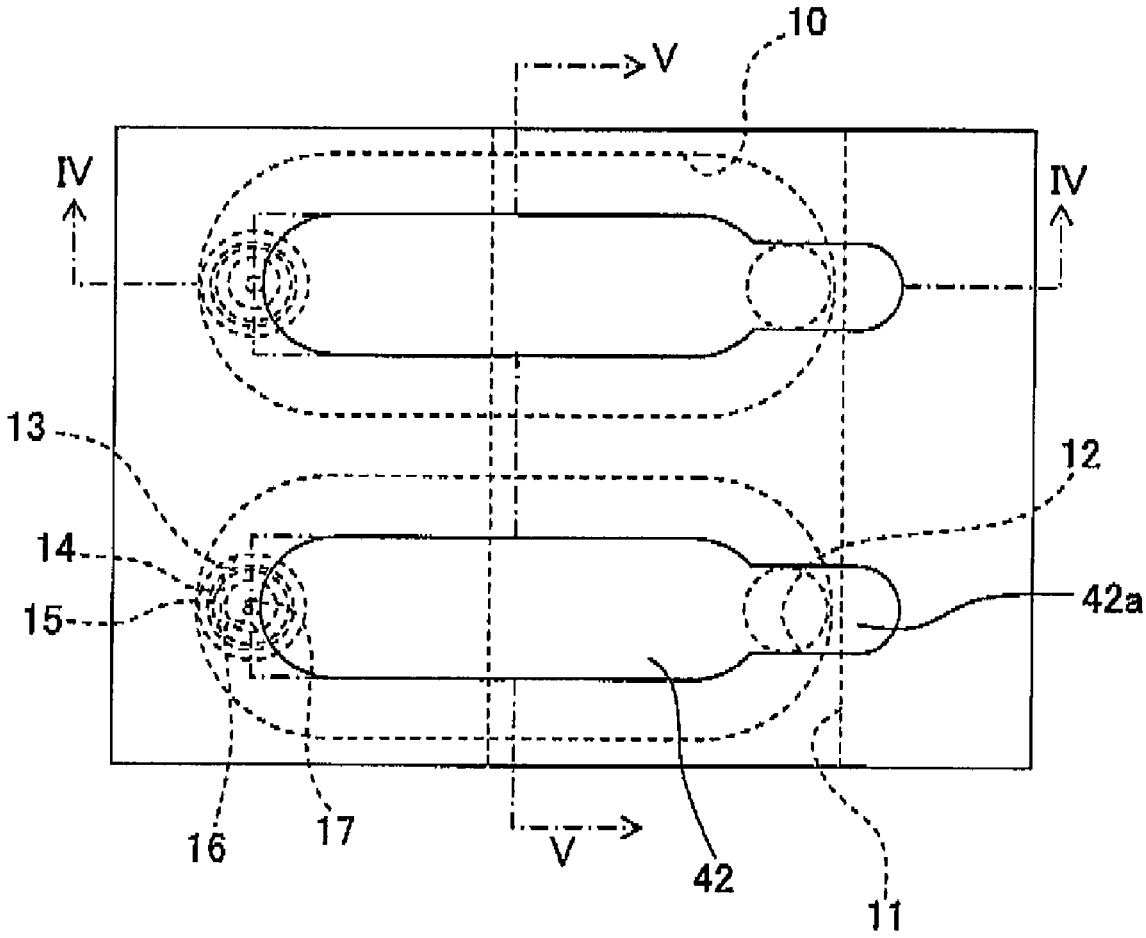
FIG. 3 shows a partial magnified view illustrating those shown in FIG. 2.
Figure 4:
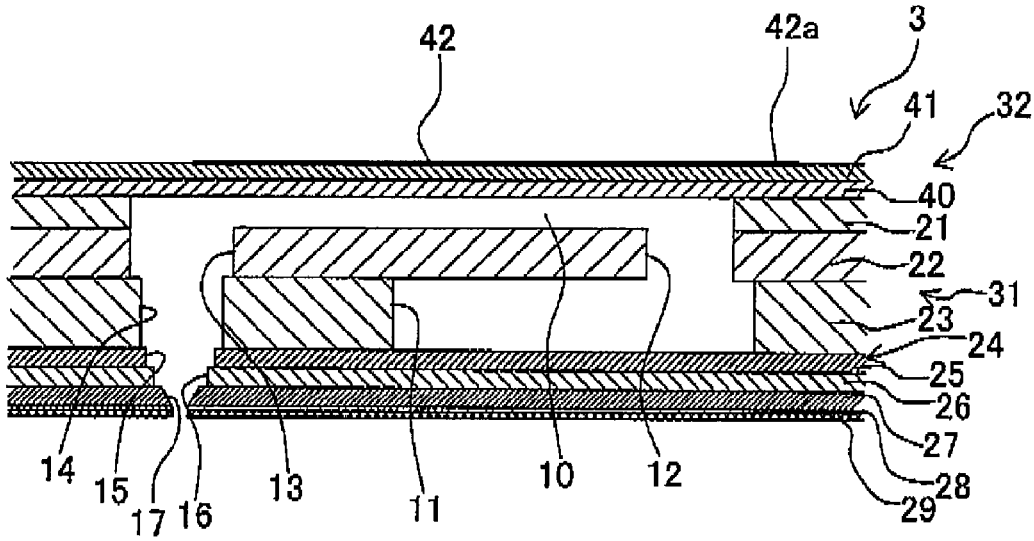
FIG. 4 shows a sectional view taken along a line IV-IV shown in FIG. 3.
Figure 5:
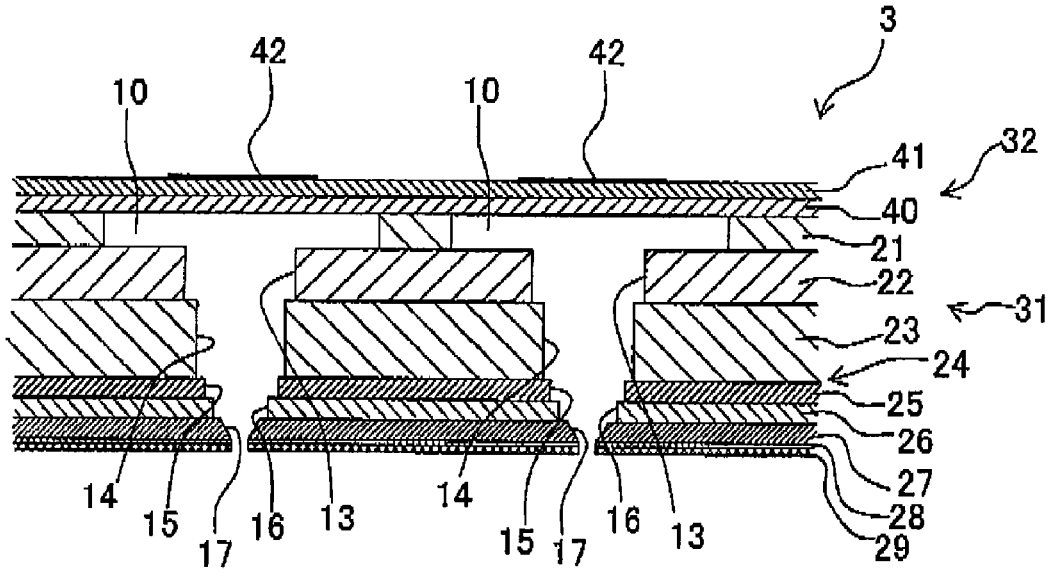
FIG. 5 shows a sectional view taken along a line V-V shown in FIG. 3.

Next, the ink-jet head 3 will be explained with reference to FIGS. 2 to 5. FIG. 2 shows a plan view illustrating the ink-jet head 3 shown in FIG. 1. FIG. 3 shows a partial magnified view illustrating those shown in FIG. 2. FIG. 4 shows a sectional view taken along a line IV-IV shown in FIG. 3. FIG. 5 shows a sectional view taken along a line V-V shown in FIG. 3.

As shown in FIGS. 2 to 5, the ink-jet head 3 is provided with a flow passage unit 31 which has a plurality of individual ink flow passages formed therein, and a piezoelectric actuator 32 which is arranged on the upper surface of the flow passage unit 31.

The flow passage unit 31 is provided with a cavity plate 21, a base plate 22, a manifold plate 23, and a nozzle plate 24. These plates are joined to each other in a stacked state.

Each of the cavity plate 21, the base plate 22, and the manifold plate 23 is a plate-shaped member which is substantially rectangular as viewed in a plan view and which is formed of a metal material such as stainless steel. A plurality of pressure chambers 10, which are arranged in two arrays along the plane, are formed in the cavity plate 21. Each of the pressure chambers 10 is formed to have a substantially elliptical shape as viewed in a plan view. The pressure chambers 10 are arranged so that the major axis direction thereof is the scanning direction (left-right direction as shown in FIG. 2). A plurality of through-holes 12, 13 are formed respectively at positions overlapped with the both ends in the major axis direction of each of the plurality of pressure chambers 10 as viewed in a plan view of the base plate 22.

A manifold flow passage 11, which extends in two arrays in the paper feeding direction (upward-downward direction as shown in FIG. 2) and which is overlapped with left ends or right ends of the pressure chambers 10 shown in FIG. 2 as viewed in a plan view, is formed for the manifold plate 23. An ink is supplied to the manifold flow passage 11 from an ink supply port 9 formed for a vibration plate 40 as described later on. A plurality of through-holes 14 are formed in the manifold plate 22 at positions overlapped with the ends of the plurality of pressure chambers 10 on the side opposite to the manifold flow passage 11 as viewed in a plan view.

The nozzle plate 24 is constructed by mutually stacking, from the upper side, a thermoplastic resin film 25 (second thermoplastic resin film), a reinforcing plate 26, and a thermoplastic resin film 27 (first thermoplastic resin film). Both of the thermoplastic resin film 25 and the thermoplastic resin film 27 are plates which are formed of the same thermoplastic resin material (for example, thermoplastic polyimide resin), and they also have approximately the same thickness (appropriately about 20 to 80 μm, for example, about 50 μm). The reinforcing plate 26 is a plate which is formed of a metal material such as stainless steel or 42 alloy having a rigidity higher than those of the thermoplastic resin films 25, 27. The reinforcing plate 26 reinforces the thermoplastic resin films 25, 27 by being joined or bonded to the thermoplastic resin films 25, 27. Accordingly, the rigidity of the nozzle plate 24 is enhanced.

A plurality of through-holes 15 are formed in the thermoplastic resin film 25 at positions overlapped with the ends of the plurality of pressure chambers 10 on the side opposite to the manifold flow passage 11 as viewed in a plan view. A plurality of through-holes 16 are formed in the reinforcing plate 26 at positions overlapped with the ends of the plurality of pressure chambers 10 on the side opposite to the manifold flow passage 11 as viewed in a plan view. A plurality of nozzles 17 are formed in the thermoplastic resin film 27 at positions overlapped with the ends of the plurality of pressure chambers 10 on the side opposite to the manifold flow passage 11 as viewed in a plan view. That is, the plurality of nozzles 17 are formed in the thermoplastic resin film 27, and the through-holes 15, 16, which are communicated with the nozzles 17, are formed in the thermoplastic resin film 25 and the reinforcing plate 26 respectively.

A primer layer 28 is formed on the lower surface of the thermoplastic resin film 27. A water-repellent film 29 is formed on the lower surface of the primer layer 28. In this arrangement, the primer layer 28 is a layer to serve as an underlayer when the water-repellent film 29 is formed. The primer layer 28 is provided to make tight contact or adhesion between the water-repellent film 29 and the lower surface of the thermoplastic resin film 27. When the water-repellent film 29 is formed of a material which sufficiently makes tight contact with the thermoplastic resin film, it is also allowable that the primer layer 28 is not formed.

In the flow passage unit 31, as shown in FIGS. 2 to 5, the manifold flow passage 11 is communicated via the through-holes 12 with the pressure chambers 10, and the pressure chambers 10 are communicated via the through-holes 13 to 16 with the nozzles 17. In this way, the plurality of individual ink flow passages are formed in the flow passage unit 31, which range from the outlets of the manifold flow passage 11 via the pressure chambers 10 to the nozzles 17.

Next, the piezoelectric actuator 32 will be explained. As shown in FIGS. 2 to 5, the piezoelectric actuator 32 has the vibration plate 40 which is conductive and which is arranged on the surface of the cavity plate 21, a piezoelectric layer 41 which is formed continuously on the upper surface of the vibration plate 40 to range over the plurality of pressure chambers 10, and a plurality of individual electrodes 42 (driving electrodes) which are formed on the surface of the piezoelectric layer 41 to correspond to the plurality of pressure chambers 10 respectively.

The vibration plate 40 is formed of a metal material including, for example, iron-based alloy such as stainless steel, nickel alloy, aluminum alloy, and titanium alloy. As shown in FIGS. 2 to 5, the vibration plate 40 is joined or bonded to the cavity plate 21 to cover the plurality of pressure chambers 10 therewith. The vibration plate 40 also serves as a common electrode which is opposed to the plurality of individual electrodes 42 to allow the electric field to act in the piezoelectric layer 41 between the individual electrodes 42 and the vibration plate 40. The vibration plate 40 is connected to an unillustrated driver IC, which is always retained at the ground electric potential.

The piezoelectric layer 41, which is formed of a piezoelectric material containing a main component of lead zirconium titanate (PZT) having the ferroelectricity as a mixed crystal (three-dimensional metal oxide) of lead titanate and lead zirconate, is formed on the upper surface of the vibration plate 40. The piezoelectric layer 41 is formed continuously over the entire region of the upper surface of the vibration plate 40 to range over the plurality of pressure chambers 10. The piezoelectric layer 41 is previously polarized in the thickness direction thereof. The piezoelectric layer 41 is formed by using the aerosol deposition method (AD method, particle deposition method) in which ultrafine particles of the piezoelectric material are deposited by allowing them to collide with the upper surface of the vibration plate 40 at a high velocity. Alternatively, the piezoelectric layer 41 can be also formed by using other particle deposition methods including, for example, the sol-gel method, the sputtering method, the hydrothermal method, and the CVD (chemical vapor deposition) method.

As shown in FIGS. 2 to 5, the plurality of substantially elliptical individual electrodes 42, each of which has a planar shape that is one size smaller than that of the pressure chamber 10, are formed on the upper surface of the piezoelectric layer 41. The plurality of individual electrodes 42 are formed to overlap with central portions of the corresponding pressure chambers 10 respectively as viewed in a plan view. The individual electrode 42 is formed of a conductive material such as gold, copper, silver, palladium, platinum, and titanium. A plurality of contact portions 42*a*, each of which extends to a portion not opposed to the pressure chamber 10 as viewed in a plan view from one end (end on the side of the manifold flow passage 11) of each of the plurality of individual electrodes 42, are formed on the upper surface of the piezoelectric layer 41. The individual electrodes 42 and the contact portions 42*a* can be formed, for example, by the screen printing, the sputtering method, and the vapor deposition method. The contact portions 42*a* are connected to the unillustrated driver IC via an unillustrated flexible printed circuit board (FPC).

Next, the operation of the piezoelectric actuator 32 will be explained. When the driving electric potential is selectively applied from the driver IC to the individual electrode 42, the electric field is generated in the upward-downward direction in the piezoelectric layer 41 at the portion interposed between the individual electrode 42 to which the driving electric potential is applied and the vibration plate 40 which also serves as the common electrode and which is retained at the ground electric potential. Accordingly, the portion of the piezoelectric layer 41, which is disposed just under the individual electrode 42 applied with the driving electric potential, is shrunk in the horizontal direction perpendicular to the thickness direction which is the direction of polarization. In accordance with the shrinkage, the piezoelectric layer 41 and the vibration plate 40, which are disposed in the area opposed to the pressure chamber 10, are deformed so that they project toward the pressure chamber 10. Accordingly, the volume of the pressure chamber 10 is decreased, and the pressure of the ink is raised. Therefore, the ink is discharged from the nozzle 17 communicated with the pressure chamber 10.

Next, an explanation will be made about a method for producing the ink-jet head 3. FIG. 6 shows steps to illustrate the process of producing the nozzle plate 24 for constructing the ink-jet head 3. FIG. 7 shows steps to depict the process of producing the ink-jet head 3 after producing the nozzle plate 24.

Figure 6A:
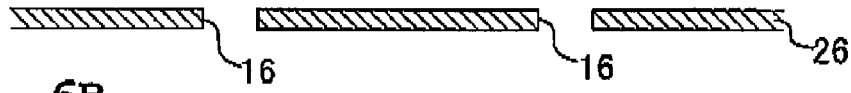
FIGS. 6A to 6F show steps to depict the process of producing a nozzle plate.

In order to produce the ink-jet head 3, at first, the plurality of through-holes 16 are formed in the reinforcing plate 26 by, for example, the etching as shown in FIG. 6A. If the through-holes 16 are formed in the reinforcing plate 26 by the etching, it is difficult to form the through-holes 16 after joining the thermoplastic resin films 25, 27. However, by forming the through-holes 16 in the reinforcing plate 26 by the etching before joining the thermoplastic resin films 25, 27 to the reinforcing plate 26, the through-holes 16 are easily formed.

Figure 6B:
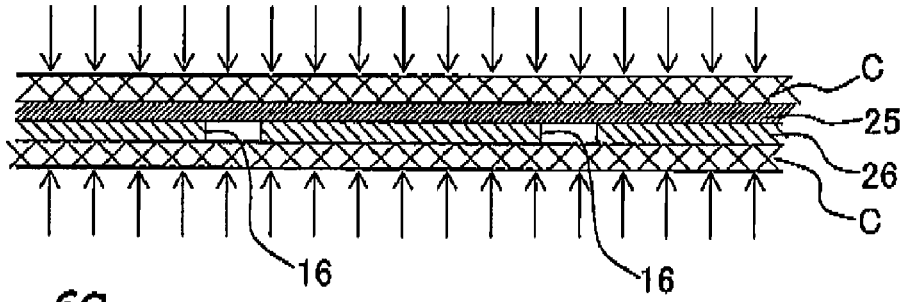

Subsequently, as shown in FIG. 6B, the thermoplastic resin film 25, in which the through-holes 15 are not formed, is arranged on the upper surface of the reinforcing plate 26 (the reinforcing plate 26 is stacked on one surface of the thermoplastic resin film 25), and the components are interposed by cushion members C from the both sides in the upward-downward direction (stacking direction) in which they are stacked, followed by being heated, for example, at about 360° C. while being pressed from the both sides in the upward-downward direction (or they may be pressed from one side) (second joining step). In this situation, the lower surface of the thermoplastic resin film 25 is deformed, which enters the gaps or interstices between irregularities of the upper surface of the reinforcing plate 26. When the heating is stopped, then the thermoplastic resin film 25 is cured, and the lower surface of the thermoplastic resin film 25 and the upper surface of the reinforcing plate 26 are meshed with each other. Accordingly, the reinforcing plate 26 and the thermoplastic resin film 25 are joined or bonded to each other.

Figure 6C:
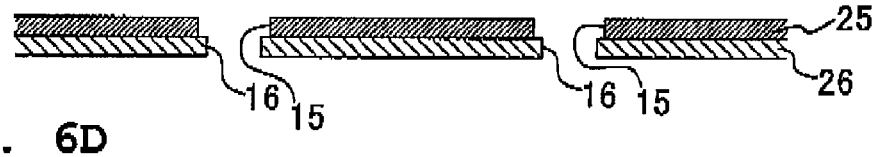

Subsequently, as shown in FIG. 6C, the plurality of through-holes 15 are formed by the laser processing at portions of the thermoplastic resin film 25 overlapping with the plurality of through-holes 16 of the reinforcing plate 26 as viewed in a plan view. In this procedure, the intensity of the laser is set to such an extent that the thermoplastic resin film 25 can be processed. Even when the laser is irradiated onto the reinforcing plate 26, the reinforcing plate 26 is not eroded. Further, the laser is not irradiated onto the thermoplastic resin film 27, and the thermoplastic resin film 27 is not eroded as well, because the thermoplastic resin film 27 is not joined. Therefore, any processing failure is hardly caused.

Figure 6D:
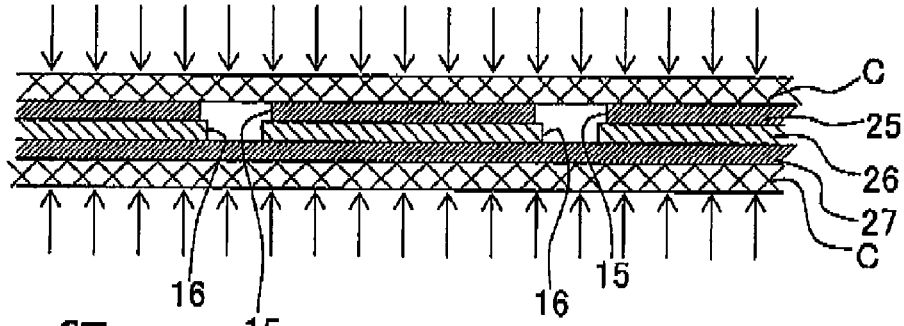

Subsequently, as shown in FIG. 6D, the thermoplastic resin film 27, in which the nozzles 27 are not formed, is arranged on the lower surface of the reinforcing plate 26 (joining surface: surface on the side opposite to the side on which the thermoplastic resin film 25 is joined). The stack, which is composed of the thermoplastic resin film 25, the reinforcing plate 26, and the thermoplastic resin film 27, is interposed by the cushion members C from the both sides in the upward-downward direction in which they are stacked, and they are heated, for example, at about 360° C. while being pressed from the both sides in the upward-downward direction (or they may be pressed from one side) (first joining step). In this situation, the upper surface of the thermoplastic resin film 27 is deformed, which enters the gaps or interstices between irregularities of the lower surface of the reinforcing plate 26. When the heating is stopped, then the thermoplastic resin film 27 is cured, and the upper surface of the thermoplastic resin film 27 and the lower surface of the reinforcing plate 26 are meshed with each other. Accordingly, the reinforcing plate 26 and the thermoplastic resin film 27 are joined or bonded to each other.

Figure 6E:
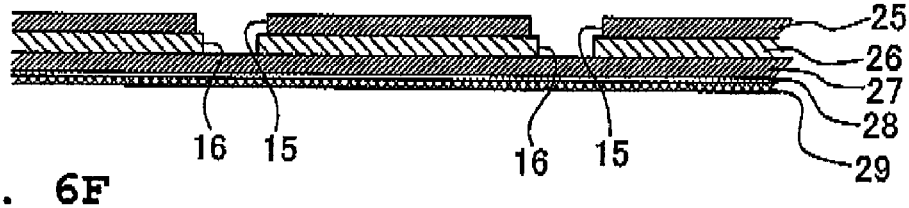
Figure 6F:
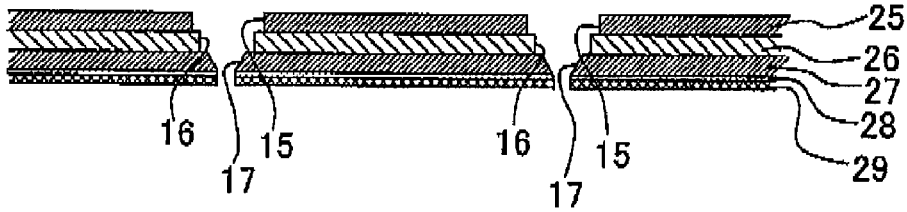

Subsequently, as shown in FIG. 6E, the primer layer 28 and the water-repellent film 29 are formed on the lower surface of the thermoplastic resin film 27. Subsequently, as shown in FIG. 5F, the nozzles 17 are formed by the laser processing. The nozzle plate 24 is produced as described above (nozzle plate-producing step).

In this procedure, the primer layer 28 and the water-repellent film 29 are formed such that the lower surface of the thermoplastic resin film 27 is coated with a material for constructing the primer layer 28, followed by being coated with a material for constructing the water-repellent film 29 so that they are heated and dried. However, the nozzles 17 may be formed after drying the materials for constructing the primer layer 28 and the water-repellent film 29. Alternatively, the nozzles 17 may be formed before drying the materials for constructing the primer layer 28 and the water-repellent film 29 after applying the materials. In any case, the materials, which are to be converted into the primer layer 28 and the water-repellent film 29, are applied to the lower surface of the thermoplastic resin film 27 before forming the nozzles 17. Therefore, the materials do not flow into the nozzles 17 when the materials are applied.

The nozzles 17 can be easily formed for the thermoplastic resin film 27 by the laser processing. Further, the diameter of the nozzle 17 (for example, 20 to 50 μm) is sufficiently smaller than the diameter of the through-hole 15 (for example, 100 μm). Therefore, when the laser processing is performed, any processing failure is hardly caused, which would be otherwise caused, for example, such that the laser is irradiated onto the thermoplastic resin film 25, and the thermoplastic resin film 25 is eroded during the laser processing.

When the nozzle plate 24 is produced as described above, the thermoplastic resin films 25, 27 and the reinforcing plate 26, which constitute the nozzle plate 24, can be joined to each other without using any adhesive.

The thermoplastic resin films 25, 27 are joined to the upper surface and the lower surface of the reinforcing plate 26 respectively. Therefore, it is possible to avoid the occurrence of any warpage in the thermoplastic resin films 25, 27 and the reinforcing plate 26, which would be otherwise caused by the difference in coefficient of thermal expansion among the reinforcing plate 26 and the thermoplastic resin films 25, 27.

Further, the thermoplastic resin film 25 and the thermoplastic resin film 27 are formed of a same thermoplastic resin material, and their thicknesses are approximately same as well. Therefore, it is possible to reliably avoid the warpage as described above.

Figure 7A:
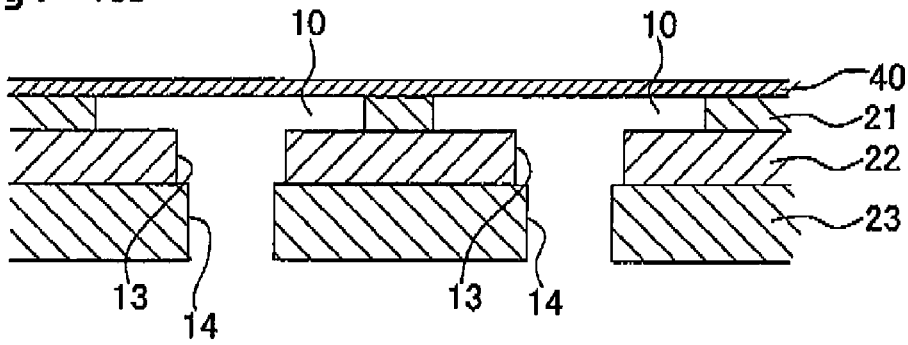
FIGS. 7A to 7D show steps to depict the process of producing the ink-jet head.
Figure 7B:
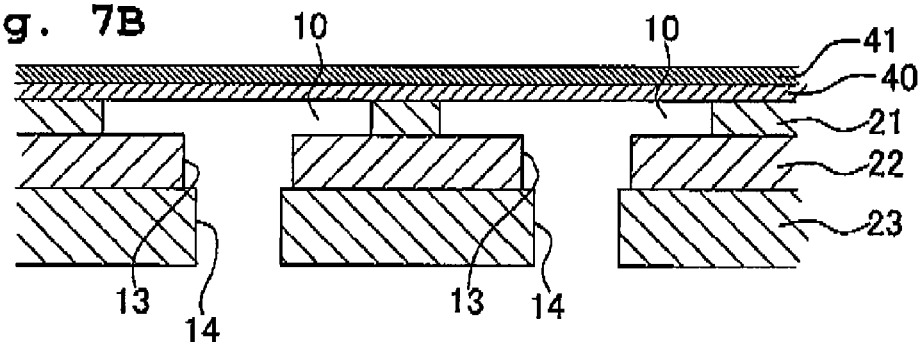
Figure 7C:
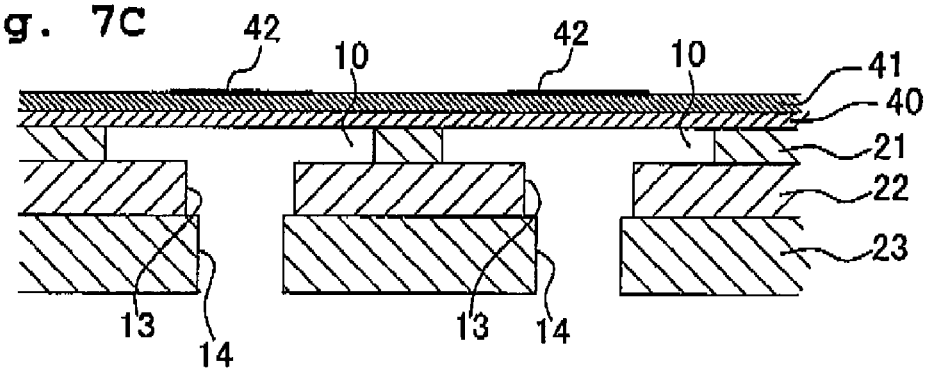

Subsequently, as shown in FIG. 7A, the plates 21 to 23 each formed of the metal material and the vibration plate 40 are stacked to each other, and they are heated at a high temperature (for example, about 1,000° C.) while being pressed from the both sides in the upward-downward direction (or they may be pressed from one side). Accordingly, the metal molecules of the respective plates are diffused to the adjoining plates, and thus they are bonded to each other. That is, the plates 21 to 23 are joined or bonded to each other by the diffusion bonding or diffusion joining (diffusion bonding step). Subsequently, as shown in FIG. 7B, the piezoelectric layer 41 is formed on the upper surface of the vibration plate 40 (on the surface on the side opposite to the pressure chambers 10), for example, by the AD method (piezoelectric layer-forming step). Subsequently, as shown in FIG. 7C, the individual electrodes 42 are formed on the upper surface of the piezoelectric layer 41, for example, by the screen printing (driving electrode-forming step).

Figure 7D:
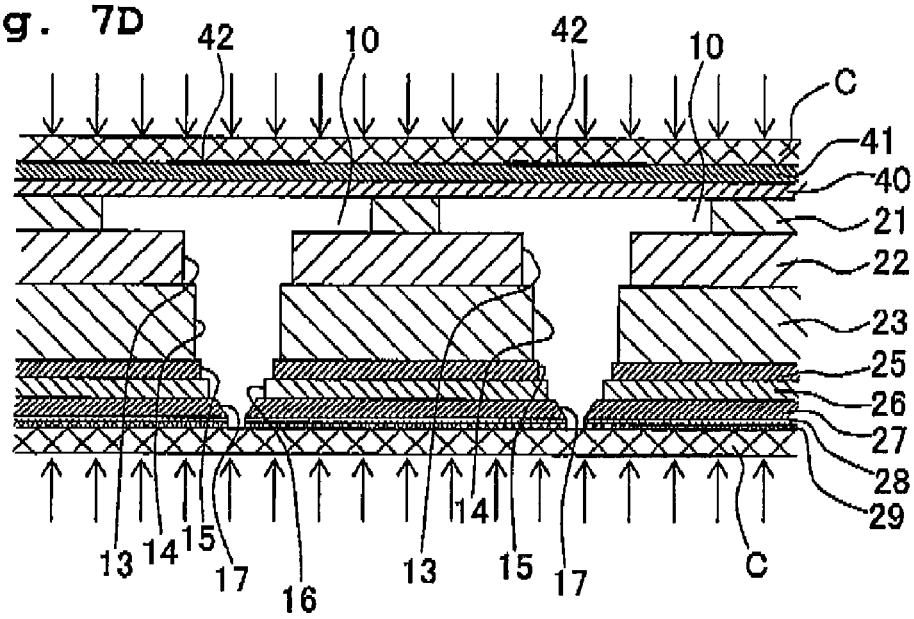

Subsequently, as shown in FIG. 7D, the nozzle plate 24 is arranged on the lower surface of the manifold plate 23 so that the upper surface of the thermoplastic resin film 25 makes contact with the lower surface of the manifold plate 23 positioned at the lowest position of the plates 21 to 23, i.e., the surface of the manifold plate 23 (first plate) which does not face the vibration plate 40 and which is joined at the position farthest from the vibration plate 40 in relation to the direction in which the plurality of plates 21 to 23 are stacked, the manifold plate 23 being included in the plurality of mutually stacked plates 21 to 23. The plates 21 to 23, the vibration plate 40, the piezoelectric layer 41, the driving electrode 42, and the nozzle plate 24 are interposed by the cushion members C from the both sides in the upward-downward direction, and they are heated, for example, at about 360° C. while being pressed from the both sides in the upward-downward direction (or they may be pressed from one side). In this situation, the upper surface of the thermoplastic resin film 25 is deformed, which enters the gaps or interstices between irregularities of the lower surface of the manifold plate 23. When the heating is stopped, then the thermoplastic resin film 25 is cured, and the upper surface of the thermoplastic resin film 25 and the lower surface of the manifold plate 23 are meshed with each other. Accordingly, the thermoplastic resin film 25 and the manifold plate 23 are joined or bonded to each other.

The ink-jet head 3 is produced as described above. When the ink-jet head 3 is produced as described above, the plates 21 to 23, the vibration plate 40, the piezoelectric layer 41, the individual electrodes, and the nozzle plate 24, which constitute the ink-jet head 3, can be joined to each other without using any adhesive.

According to the embodiment explained above, the nozzle plate 24 and the manifold plate 23 are stacked so that the upper surface of the thermoplastic resin film 25 makes contact with the lower surface of the manifold plate 23, and they can be joined to each other by heating them while pressing them from the both sides in the upward-downward direction (or they may be pressed from one side). Therefore, the nozzle plate 24 and the manifold plate 23 can be joined to each other without using any adhesive.

Further, the thermoplastic resin films 25, 27 are stacked on the upper surface and the lower surface of the reinforcing plate 26 respectively, and they are heated while being pressed from the both sides in the upward-downward direction (or they may be pressed from one side). Accordingly, they can be joined to each other. Therefore, it is possible to produce the nozzle plate 24 without using any adhesive.

The through-holes 15 and the nozzles 17 can be easily formed in the thermoplastic resin films 25, 27 by the laser processing respectively.

The thermoplastic resin films 25, 27, which are joined to the upper surface and the lower surface of the reinforcing plate 26 respectively, are formed of the same thermoplastic resin material, and they have approximately the same thickness. Therefore, any warpage is hardly caused in the reinforcing plate 26 and the thermoplastic resin films 25, 27, which would be otherwise caused by the difference in coefficient of thermal expansion among the reinforcing plate 26 and the thermoplastic resin films 25, 27.

The rigidity of the nozzle plate 24 is sufficiently high, because the reinforcing plate 26 is formed of the metal material. Further, the through-holes 16 can be easily formed in the reinforcing plate 26 formed of the metal material, for example, by the etching.

Further, when the through-holes 16 are formed in the reinforcing plate 26 by the etching, it is difficult to form the through-holes 16 after joining the thermoplastic resin films 25, 27. However, by forming the through-holes 16 in the reinforcing plate 26 by the etching before joining the thermoplastic resin films 25, 27 to the reinforcing plate 26, the through-holes 16 are easily formed. Even after the thermoplastic resin films 25, 27 are joined to the reinforcing plate 26, the through-holes 15 and the nozzles 17 can be easily formed in the thermoplastic resin films 25, 27 by the laser processing respectively.

Additionally, the plates 21 to 23, the vibration plate 50, the piezoelectric layer 51, the individual electrodes 52, and the nozzle plate 24, which constitute the ink-jet head 3, can be joined to each other without using any adhesive.

Next, an explanation will be made about modified embodiments in which various modifications are applied to the embodiment of the present invention. However, those constructed in the same manner as those of the embodiment of the present invention are designated by the same reference numerals, any explanation of which will be appropriately omitted.

Figure 8A:
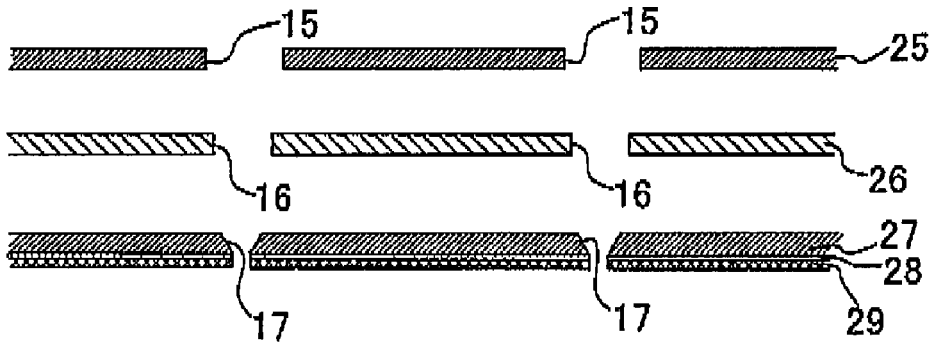
FIGS. 8A and 8B show steps of producing an ink-jet head in a first modified embodiment.
Figure 8B:
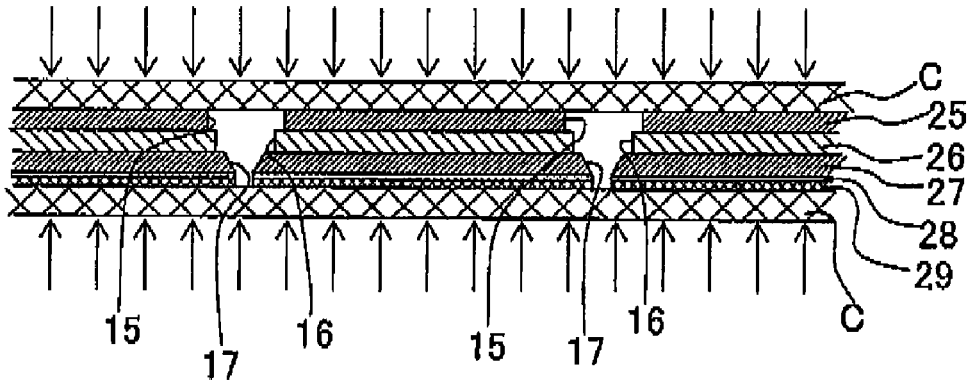

In one modified embodiment, as shown in FIG. 8A, the plurality of through-holes 15, 16 and the nozzles 17 are formed in the thermoplastic resin film 25, the reinforcing plate 26, and the thermoplastic resin film 27 respectively, and the primer layer 28 and the water-repellent film 29 are formed on the lower surface of the thermoplastic resin film 27 beforehand. As shown in FIG. 8B, the thermoplastic resin film 25 is arranged on the upper surface of the reinforcing plate 26, the thermoplastic resin film 27 is arranged on the lower surface of the reinforcing plate 26 (joining surface), and they are mutually stacked. They are interposed by the cushion members C from the both sides in the upward-downward direction, and they are heated while being pressed from the both side in the upward-downward direction (or they may be pressed from one side). Accordingly, the thermoplastic resin film 25, the reinforcing plate 26, and the thermoplastic resin film 27 are joined to each other (first modified embodiment).

If it is intended that the through-holes 15, 16 and the nozzles 17 are formed in the thermoplastic resin film 25, the reinforcing plate 26, and the thermoplastic resin film 27 after they are joined to each other, it is feared that the steps of forming the through-holes 15, 16 and the nozzles 17 may be complicated. However, when the thermoplastic resin film 25, the reinforcing plate 26, and the thermoplastic resin film 27 are joined to each other after forming the through-holes 15, 16 and the nozzles 17 in them, it is easy to form the through-holes 15, 16 and the nozzles 17.

In this procedure, the joining of the thermoplastic resin film 25 and the reinforcing plate 26 can be performed simultaneously with the joining of the reinforcing plate 26 and the thermoplastic resin film 27. That is, it is possible to simultaneously perform the first joining step and the second joining step according to the present invention. Therefore, the steps of producing the nozzle plate 24 are simplified.

Figure 9A:
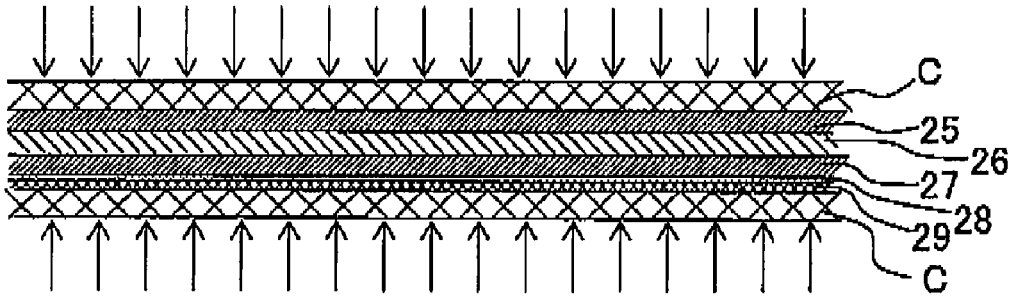
FIGS. 9A and 9B show steps of producing a nozzle plate in a second modified embodiment.
Figure 9B:
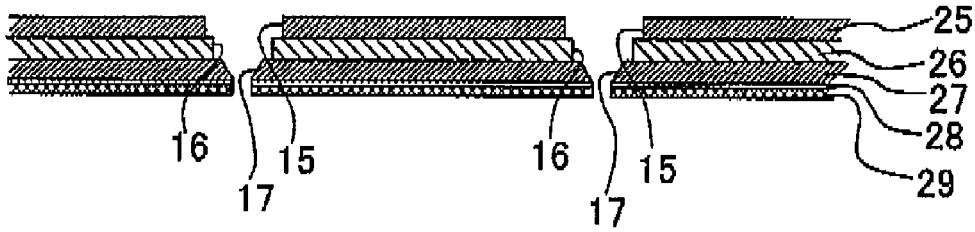

In another modified embodiment, as shown in FIG. 9A, those mutually stacked are the thermoplastic resin film 25 in which the plurality of through-holes 15 are not formed, the reinforcing plate 26 in which the plurality of through-holes 16 are not formed, and the thermoplastic resin film 27 in which the plurality of nozzles 17 axe not formed and which has the primer layer 28 and the water-repellent layer 29 formed on the lower surface. The components are interposed by the cushion members C from the both sides in the upward-downward direction, and they are heated while being pressed from the both side in the upward-downward direction (or they may be pressed from one side). Accordingly, the thermoplastic resin film 25, the reinforcing plate 26, and the thermoplastic resin film 27 are joined to each other. After that, as shown in FIG. 9B, the plurality of through-holes 15 are formed in the thermoplastic resin film 25 by the laser processing, the plurality of through-holes 16 are formed in the reinforcing plate 26 by the etching, and the plurality of nozzles 17 are formed in the thermoplastic resin film 27 by the laser processing (second modified embodiment).

In this procedure, the through-holes 15, 16 and the nozzles 17 are formed after joining the thermoplastic resin films 25, 27 and the reinforcing plate 26. Therefore, when the thermoplastic resin films 25, 27 and the reinforcing plate 26 are stacked, it is unnecessary to perform the positional adjustment for the through-holes 15, 16 and the nozzles 17.

Also in this procedure, the joining of the thermoplastic resin film 25 and the reinforcing plate 26 can be performed simultaneously with the joining of the reinforcing plate 26 and the thermoplastic resin film 27. That is, the first joining step and the second joining step according to the present invention are performed simultaneously. Therefore, the steps of producing the nozzle plate 24 are simplified.

Figure 10:
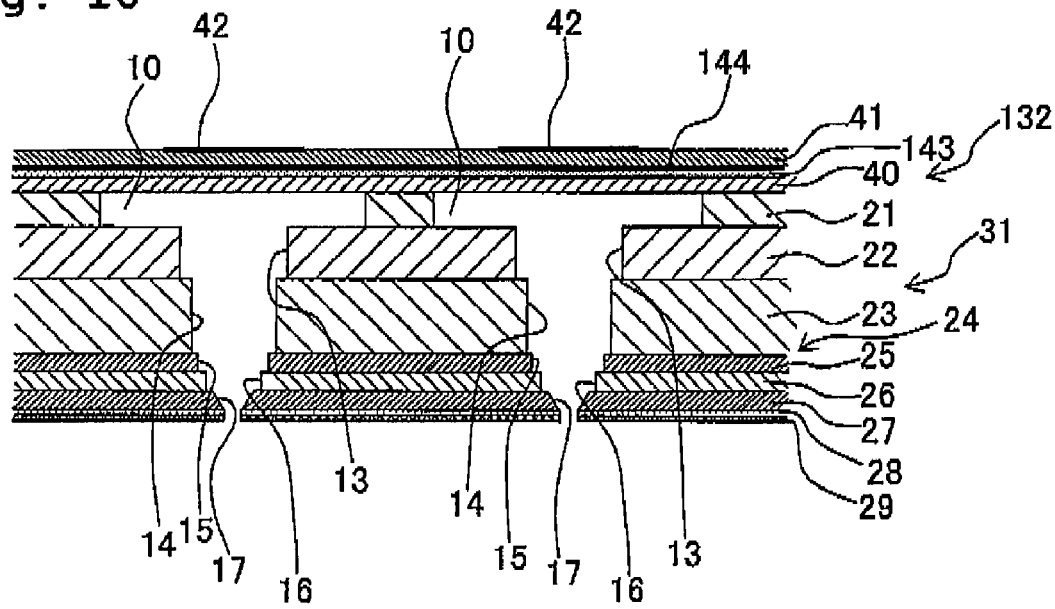
FIG. 10 shows a sectional view illustrating a third modified embodiment corresponding to FIG. 5.

In the embodiment of the present invention, the vibration plate 40 also serves as the common electrode. However, the common electrode may be provided distinctly from the vibration plate 40. For example, in still another modified embodiment, as shown in FIG. 10, an alumina layer 143 is formed in the entire region of the upper surface of the vibration plate 40, and a common electrode 144 is formed in the entire region of the upper surface of the alumina layer 143. The piezoelectric layer 41 and the individual electrodes 42, which are the same as or equivalent to those of the embodiment of the present invention, are formed on the upper surface of the common electrode 144 (third modified embodiment). In this arrangement, the alumina layer 143 is provided to insulate the vibration plate 40 from the common electrode 144. Further, the alumina layer 143 is provided to avoid the diffusion of the metal for constructing the vibration plate 40 to the piezoelectric layer 41 when the annealing treatment is performed to heat the piezoelectric layer 41 at a high temperature after forming the piezoelectric layer 41.

Also in this case, the plates 21 to 23 and the vibration plate 40 are joined to each other in the same manner as in the embodiment of the present invention, and then the alumina layer 143 is formed on the upper surface of the vibration plate 40, for example, by the sputtering method. The common electrode 144 is formed on the upper surface of the alumina layer 143, for example, by the screen printing, and then the piezoelectric layer 41 and the individual electrodes 42 are formed in the same manner as in the embodiment of the present invention. The nozzle plate 24 is joined to the lower surface of the manifold plate 23. Accordingly, the respective members for constructing the ink-jet head can be joined to each other without using any adhesive.

In the foregoing explanation, the nozzle plate 24 is joined to the manifold plate 23 after producing the nozzle plate 24. However, the thermoplastic resin film 25, the reinforcing plate 26, and the thermoplastic resin film 27, which are not stacked to each other, may be stacked on the lower portion of the manifold plate 23. In this case, the manifold plate 23 may be formed of 42 alloy or the like. The stack, which is composed of the plates 21 to 23, the vibration plate 40, the piezoelectric layer 41, the individual electrodes 42, the thermoplastic resin film 25, the reinforcing plate 26, and the thermoplastic resin film 27, may be heated while being pressed from the both sides in the upward-downward direction (or the stack may be pressed from one side), and thus the manifold plate 23, the thermoplastic resin film 25, the reinforcing plate 26, and the thermoplastic resin film 27 may be joined to each other. In this procedure, the first joining step, the second joining step, and the nozzle plate-joining step according to the present invention are performed simultaneously.

In the foregoing explanation, the thermoplastic resin films 25, 27 are formed of the same thermoplastic resin material, and their thicknesses are approximately same each other as well. However, the thermoplastic resin film 25 and the thermoplastic resin film 27 may be formed of mutually different thermoplastic resin materials. Alternatively, the thickness of the thermoplastic resin film 25 and the thickness of the thermoplastic resin film 27 may be different from each other. Also in such cases, the thermoplastic resin films 25, 27 are joined to the upper surface and the lower surface of the reinforcing plate 26. Therefore, the warpage, which would be otherwise caused by the difference in coefficient of thermal expansion among the reinforcing plate 26 and the thermoplastic resin films 25, 27, can be reduced as compared with a case in which the thermoplastic resin film is joined to only any one of the upper surface and the lower surface of the reinforcing plate 26.

In the foregoing explanation, the reinforcing plate 26 and the thermoplastic resin film 25 are joined to each other, and then the reinforcing plate 26 and the thermoplastic resin film 27 are joined to each other, or the thermoplastic resin films 25, 27 and the reinforcing plate 26 are simultaneously joined to each other. However, the reinforcing plate 26 and the thermoplastic resin film 25 may be joined to each other after joining the reinforcing plate 26 and the thermoplastic resin film 27. That is, the second joining step may be performed after the first joining step according to the present invention.

Further, it is also allowable that a treatment to roughen the surface, such as plasma-treatment, may be applied to the upper surface and the lower surface of the reinforcing plate 26 in order to form irregularities. In this case, the thermoplastic resin films 25, 27 and the reinforcing plate 26 are meshed with each other more reliably. Therefore, it is possible to reliably join the thermoplastic resin films 25, 27 and the reinforcing plate 26. Similarly, in order to more reliably join the thermoplastic resin film 25 and the manifold plate 23, a treatment to roughen the surface may be applied to the lower surface of the manifold plate 23.

Figure 11:
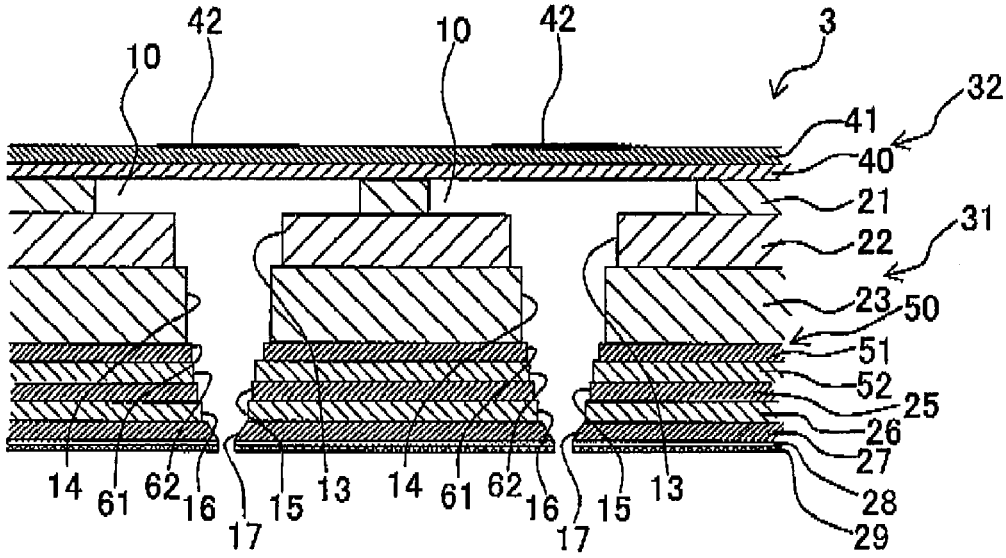
FIG. 11 shows a sectional view illustrating a fourth modified embodiment corresponding to FIG. 5.

In still another modified embodiment, as shown in FIG. 11, the thermoplastic resin film 25 (second thermoplastic resin film), the reinforcing plate 26, and the thermoplastic resin film 27 (first thermoplastic resin film) are stacked to each other in relation to the nozzle plate 50 in the same manner as in the embodiment of the present invention. Additionally, a reinforcing plate 52 is stacked on the upper surface of the thermoplastic resin film 25, and a thermoplastic resin film 51 is stacked on the upper surface of the reinforcing plate 52. The reinforcing plate 52 is formed of the same metal material as that of the reinforcing plate 26, which has the same thickness as that of the reinforcing plate 26. A plurality of through-holes 62 are formed in the reinforcing plate 52 at the positions overlapping with the plurality of through-holes 15 as viewed in a plan view. The thermoplastic resin film 51 is formed of approximately the same thermoplastic resin material as those of the thermoplastic resin films 25, 27, which has approximately the same thickness as those of the thermoplastic resin films 25, 27. A plurality of through-holes 61 are formed in the thermoplastic resin film 51 at the positions overlapping with the plurality of through-holes 62 as viewed in a plan view (fourth modified embodiment).

In this arrangement, the thermoplastic resin films 25, 27 are joined to the upper surface and the lower surface of the reinforcing plate 26 respectively, and the thermoplastic resin films 25, 51 are joined to the upper surface and the lower surface of the reinforcing plate 52 respectively. Further, the reinforcing plate 52 and the thermoplastic resin film 51 are joined to the upper surface of the thermoplastic resin film 25, and the reinforcing plate 26 and the thermoplastic resin film 27 are joined to the lower surface of the thermoplastic resin film 25. Therefore, the occurrence of any warpage is avoided, which would be otherwise caused in the reinforcing plates 26, 52 and the thermoplastic resin films 25, 27, 51 by the difference in coefficient of thermal expansion among the reinforcing plates 26, 52 and the thermoplastic resin films 25, 27, 51. In the case of the nozzle plate 50, the numbers of the stacked thermoplastic resin films and the stacked reinforcing plates are larger than those of the nozzle plate 24. Therefore, the strength is enhanced corresponding thereto.

In the foregoing explanation, each of the reinforcing plates 26, 52 is formed of the metal material. However, the reinforcing plate may be formed of any material other than the metal on condition that the material has a rigidity higher than that of the thermoplastic resin film.

Next, the peel test was carried out in order to investigate the joining strength or joint strength between the metal material to be used as the reinforcing plate and the films to be joined to the metal material. 42 alloy was used as a metal material. Polyimide film "Kapton 300V" produced by DuPont-Toray/TDC, polyimide film "UPILEX 75S" produced by Ube Industries, Ltd, polyimide film "UPILEX 75RN" produced by Ube Industries, Ltd, liquid crystal polymer film "VECSTAR OC" produced by Kuraray CO., LTD, and thermoplastic polyimide resin film produced by TAIYO INK MFG CO., LTD were used as films. The films were joined to 42 alloy with various thicknesses for each film and in case of presence or absence of a surface treatment. Thermosetting resin ("Kapton 300V", "UPILEX 75S", and "UPILEX 75RN") and 42 alloy were joined to each other by thermal compression using a hot press machine after applying an adhesive to joining surfaces of the thermosetting resin and 42 alloy. Thermoplastic resin (the liquid crystal polymer and the thermoplastic polyimide) and 42 alloy were joined to each other by thermal compression using a hot press machine without applying any adhesive because of adhesiveness of the thermoplastic resin. The average value and the peak value of the joining strength of the film material and 42 alloy were measured by using "EZTest" produced by SHIMADZU CORPORATION. The measurement results are shown in Table 1 below. In Table 1, the joining surface B means the surface of the film which forced a belt in a production process of the films. When each of the above films is produced, liquid raw material is applied to form a thin layer on the belt and then the layer is cured or set. The joining surface A means the other surface of the film. In general, the joining surface B has a greater surface roughness and higher joining strength than the joining surface A.

TABLE 1

| Film/thickness (μmt)/ surface treatment | Average value of film joining strength (N) | | Peak value of film joining strength (N) | |
|---|---|---|---|---|
| | Joining surface A | Joining surface B | Joining surface A | Joining surface B |
| "Kapton 300V"/75/ untreated | 1.17 | 2.04 | 3.53 | 8.55 |
| "UPILEX 75S"/75/ untreated | 0.08 | 0.26 | 0.13 | 0.41 |
| "UPILEX 75S"/75/ plasma-treatment | 0.52 | 1.67 | 0.70 | 2.55 |
| "UPILEX 75RN"/75/ untreated | 0.17 | 0.19 | 0.47 | 0.28 |
| "UPILEX 75RN"/75/ plasma-treatment | 0.49 | 0.88 | 1.00 | 1.86 |
| "VECSTAR OC"/50/ untreated | — | — | 6.90 | 6.86 |
| "VECSTAR OC"/75/ untreated | 2.84 | — | 5.79 | — |
| Thermoplastic polyimide resin film/ 75/untreated | 4.67 | 8.44 | 21.44 | 17.05 |

According to the results shown in Table 1, it is appreciated that the thermoplastic polyimide has the highest joining strength with respect to 42 alloy. This reason is considered as follows. The thermoplastic resin (liquid crystal polymer and thermoplastic polyimide) relies on a mechanical joining based on surface roughness such as an anchor effect rather than chemical bonding with 42 alloy. A passivation treatment was applied to a nozzle plate formed of 42 alloy to enhance ink-resistance so that a chemical reactivity of the nozzle plate is suppressed. As a result, a thermosetting resin ("Kapton 300V", "UPILEX 75S", and "UPILEX 75RN") for which joining is performed by chemical bonding with the adhesive has a lower joining strength. Compared with the thermoplastic polyimide, liquid crystal polymer of thermoplastic resin has a lower joining strength because the film formed of liquid crystal polymer of thermoplastic resin has a higher rigidity. According to this fact, when the thermoplastic resin film is used as the film material to be joined to the reinforcing plate in the nozzle plate in the embodiment and the modified embodiment explained above, it is possible to produce the nozzle plate having the higher adhesive strength.

The embodiment and the modified embodiments explained above are examples in which the present invention is applied to the ink-jet head. However, the applicable range of the present invention is not limited to the ink-jet head. The present invention is also applicable to any liquid discharge apparatus to be used in a variety of fields including those of the medical treatment or medical care and the analysis.

What is claimed is:

1. A nozzle plate comprising:

a first thermoplastic resin film;

a reinforcing plate formed of a material having a rigidity higher than that of the first thermoplastic resin film and having one surface as a joining surface at which the reinforcing plate is joined to the first thermoplastic resin film;

a second thermoplastic resin film which is joined to the other surface of the reinforcing plate; and a water-repellent element is bonded to a surface of the first thermoplastic resin film opposite the reinforcing plate, wherein a nozzle is formed in the first thermoplastic resin film, and a through-hole, which is communicated with the nozzle, is formed in each of the reinforcing plate and the second thermoplastic resin film.

2. The nozzle plate according to claim 1, wherein the reinforcing plate is formed of a metal material.

3. The nozzle plate according to claim 1, wherein the first thermoplastic resin film and the second thermoplastic resin film are formed of a same thermoplastic resin material.

4. The nozzle plate according to claim 3, wherein the first thermoplastic resin film and the second thermoplastic resin film have a same thickness.

5. A method for producing the nozzle plate as defined in claim 1, comprising:

joining the first thermoplastic resin film and the reinforcing plate to each other by stacking the first thermoplastic resin film and the reinforcing plate in a stacking direction and heating the first thermoplastic resin film and the reinforcing plate while pressing the first thermoplastic resin film and the reinforcing plate in the stacking direction; and joining the reinforcing plate and the second thermoplastic resin film to each other by stacking in the stacking direction the second thermoplastic resin film on the other surface of the reinforcing plate, the other surface being opposite to the joining surface, and heating the reinforcing plate and the second thermoplastic resin film while pressing the reinforcing plate and the second thermoplastic resin film in the stacking direction.

6. The method for producing the nozzle plate according to claim 5, wherein the nozzle is formed in the first thermoplastic resin film and the through-hole is formed in the reinforcing plate, before joining the first thermoplastic resin film and the reinforcing plate, and the through-hole is formed in the second thermoplastic resin film before joining the reinforcing plate and the second thermoplastic resin film.

7. The method for producing the nozzle plate according to claim 5, wherein the reinforcing plate is formed of a metal material, the through-hole is formed in the reinforcing plate by etching before joining the first thermoplastic resin film and the reinforcing plate; the nozzle is formed in the first thermoplastic resin film by laser processing after joining the first thermoplastic resin film and the reinforcing plate; and the through-hole is formed in the second thermoplastic resin film by laser processing after joining the reinforcing plate and the second thermoplastic resin film.

8. The method for producing the nozzle plate according to claim 5, wherein, after joining the reinforcing plate and the second thermoplastic resin film, the through-hole is formed in each of the second thermoplastic resin film and the reinforcing plate and the nozzle is formed in the first thermoplastic resin film.

9. A method for producing the nozzle plate as defined in claim 1, comprising:

joining the second thermoplastic resin film and the reinforcing plate to each other by stacking the second thermoplastic resin film and the reinforcing plate in a stacking direction and heating the second thermoplastic resin film and the reinforcing plate while pressing the second thermoplastic resin film and the reinforcing plate in the stacking direction; and joining the reinforcing plate and the first thermoplastic resin film to each other by stacking the first thermoplastic resin film on the other surface of the reinforcing plate in the stacking direction, the other surface being opposite to the second thermoplastic resin film, and heating the reinforcing plate and the first thermoplastic resin film while pressing the reinforcing plate and the first thermoplastic resin film in the stacking direction.

10. The method for producing the nozzle plate according to claim 9, wherein the through-hole is formed in each of the second thermoplastic resin film and the reinforcing plate before joining the second thermoplastic resin film and the reinforcing plate, and the nozzle is formed in the first thermoplastic resin film before joining the reinforcing plate and the first thermoplastic resin film.

11. The method for producing the nozzle plate according to claim 9, wherein the reinforcing plate is formed of a metal material, the through-hole is formed in the reinforcing plate by etching before joining the second thermoplastic resin film and the reinforcing plate, the through-hole is formed in the second thermoplastic resin film by laser processing after joining the second thermoplastic resin film and the reinforcing plate, and the nozzle is formed in the first thermoplastic resin film by laser processing after joining the reinforcing plate and the first thermoplastic resin film.

12. The method for producing the nozzle plate according to claim 9, wherein, after joining the reinforcing plate and the first thermoplastic resin film, the through-hole is formed in each of the reinforcing plate and the second thermoplastic resin film and the nozzle is formed in the first thermoplastic resin film.

13. A method for producing the nozzle plate as defined in claim 1, comprising:

stacking the first thermoplastic resin film and the reinforcing plate and stacking the second thermoplastic resin film on the other surface of the reinforcing plate in the stacking direction, the first thermoplastic resin film not being stacked on the other surface; and joining the first thermoplastic resin film and the reinforcing plate to each other and joining the reinforcing plate and the second thermoplastic resin film to each other by heating the first thermoplastic resin film, the reinforcing plate, and the second thermoplastic resin film while pressing the first thermoplastic resin film, the reinforcing plate, and the second thermoplastic resin film in the stacking direction.

14. The method for producing the nozzle plate according to claim 13, wherein, after joining the first thermoplastic resin film and the reinforcing plate and joining the reinforcing plate and the second thermoplastic resin film, the through-hole is formed in each of the reinforcing plate and the second thermoplastic resin film and the nozzle is formed in the first thermoplastic resin film.

15. An ink-jet head comprising:

a flow passage unit which is constructed by stacking the nozzle plate as defined in claim 1 on a plurality of plates each formed of a metal material, the flow passage having an ink flow passage including the nozzle and a pressure chamber communicated with the nozzle; and a piezoelectric actuator applying a jetting pressure to an ink in the pressure chamber and having a vibration plate formed of a metal material and arranged on a surface of the flow passage unit to cover the pressure chamber therewith, a piezoelectric layer arranged on a surface of the vibration plate not facing the flow passage unit, and a driving electrode arranged on a surface of the piezoelectric layer.

16. A method for producing an ink-jet head provided with:

a flow passage unit which is constructed by stacking the nozzle plate as defined in claim 1 and a plurality of plates with one another, each of the plates being formed of a metal material, the flow passage unit having an ink flow passage including the nozzle and a pressure chamber communicated with the nozzle; and a piezoelectric actuator applying a jetting pressure to an ink in the pressure chamber and having a vibration plate formed of a metal material and arranged on a surface of the flow passage unit to cover the pressure chamber therewith, a piezoelectric layer arranged on a surface of the vibration plate not facing the flow passage unit, and a driving electrode arranged on a surface of the piezoelectric layer, the method comprising:

providing the nozzle plate;

stacking the plurality of plates and the vibration plate and joining the plurality of plates and the vibration plate to one another in a stacking direction by diffusion bonding;

forming the piezoelectric layer on the surface of the vibration plate not facing the plurality of plates, by a particle deposition method;

forming the driving electrode on the surface of the piezoelectric layer; and joining the nozzle plate to a surface of a first plate, among the plurality of plates, not facing the vibration plate, the first plate being joined to the vibration plate at a position farthest from the vibration plate, wherein, when the nozzle plate is joined to the first plate, the nozzle plate is stacked on the surface of the first plate not facing the vibration plate so that the surface of the first plate not facing the vibration plate makes contact with a surface, of the second thermoplastic resin film, not facing the reinforcing plate, and the nozzle plate, the plurality of plates, and the piezoelectric actuator are heated while pressing the nozzle plate, the plurality of plates, and the piezoelectric actuator in the stacking direction of the nozzle plate, the plurality of plates, and the piezoelectric actuator.

17. The nozzle plate according to claim 1, wherein the water-repellent element comprises:

a primer layer formed on the surface of the first thermoplastic resin film opposite the reinforcing plate; and a water-repellent film formed on a surface of the primer layer opposite the first thermoplastic resin film, such that the primer player is disposed between the first thermoplastic resin film and the water-repellent film.

* * * * *